United States Patent [19]

Meier

[11] 4,408,754

[45] Oct. 11, 1983

[54] METHOD AND APPARATUS FOR GATHERING TOGETHER SHEETS OR THE LIKE INTO MULTI-SHEET PRINTED PRODUCTS, ESPECIALLY NEWSPAPERS AND MAGAZINES

[75] Inventor: Jacques Meier, Bäretswil, Switzerland

[73] Assignee: Ferag AG, Hinwil, Switzerland

[21] Appl. No.: 235,650

[22] Filed: Feb. 17, 1981

[30] Foreign Application Priority Data

Mar. 11, 1980 [CH] Switzerland ..... 1889/80

[51] Int. Cl.[3] ..... B65H 39/00

[52] U.S. Cl. ..... 270/52; 270/39; 270/57; 270/21.1

[58] Field of Search ..... 270/39, 55, 52, 53, 270/57, 21.1; 226/104–107

[56] References Cited

U.S. PATENT DOCUMENTS

| | | | |
|---|---|---|---|
| 674,356 | 5/1901 | Feister | 270/39 X |
| 2,050,669 | 8/1936 | Puig | 270/39 |
| 2,729,445 | 1/1956 | Webster | 270/39 |
| 3,122,362 | 2/1964 | Vollrath | 270/57 |
| 3,971,299 | 7/1976 | Whittle | 156/515 X |

FOREIGN PATENT DOCUMENTS

| | | | |
|---|---|---|---|
| 1408247 | 7/1965 | France | 270/39 |

*Primary Examiner*—A. J. Heinz

*Attorney, Agent, or Firm*—Werner W. Kleeman

[57] ABSTRACT

A number of substantially zig-zag folded webs, each of which are formed by sheets connected at fold locations or lines, are successively placed upon a revolvingly driven drum member. The webs come into contact with each second fold location upon a support rib or web, these support ribs extending radially away from the surface of the drum member and in the axial direction thereof. A separator or cutter device is arranged opposite each web at the drum member and serves to sever the web at the fold locations or lines bearing upon the support ribs. The separated sheets drop into the compartments formed between each two neighboring support ribs or webs and are retained therein by pressure fingers. During the revolving motion of the drum member the sheets are shifted in axial direction of the drum member into a position where they are aligned with the next following web. Upon the sheets separated from each web there come to bear the sheets previously separated from the other webs. The successive sheets are removed at a removal portion or section of the drum member and infed to a further processing station.

25 Claims, 8 Drawing Figures

METHOD AND APPARATUS FOR GATHERING TOGETHER SHEETS OR THE LIKE INTO MULTI-SHEET PRINTED PRODUCTS, ESPECIALLY NEWSPAPERS AND MAGAZINES

CROSS-REFEREMCE TO RELATED APPLICATION

This application is related to my commonly assigned, co-pending U.S. application Ser. No. 06/235,661, filed Feb. 17, 1981, entitled "Method and Apparatus for Forming Multi-Sheet Printed Products, Especially Newspapers and Magazines".

BACKGROUND OF THE INVENTION

The present invention relates to a new and improved method of, and apparatus for, gathering together sheets and the like into multi-sheet printed products, especially newspapers, magazines, periodicals and so forth.

With heretofore known constructions of sheet gathering or assembly devices the different sheets are located in superimposed fashion in individual stacks which are interconnected by means of a collecting belt or band. The momentarily lowermost sheet of each stack is withdrawn and placed upon the arriving superimposed sheets upon the collecting band, which have been withdrawn from the preceding stacks and placed on top of one another. Since the stacks consist of separated sheets it is necessary for the purpose of forming the stack to individually handle the sheets, so that a certain expenditure in equipment and controls is needed.

SUMMARY OF THE INVENTION

It is a primary object of the present invention to provide a new and improved method of, and apparatus for, the gathering together of sheets or the like into multi-sheet printed products, especially newspapers and magazines in an extremely reliable and efficient manner.

Another and more specific object of the present invention aims at providing a new and improved method of, and apparatus for, enabling the formation of completed printed products by placing on top of one another sheets or the like in a most simple fashion.

Now in order to implement these and still further objects of the invention which will become more readily apparent as the description proceeds, the method for gathering sheets or the like into multi-sheet printed products, especially newspapers and magazines, is manifested by the features that each of at least two zig-zag folded webs, each of which are formed by sheets interconnected with one another at fold locations or lines extending transversely with respect to the web lengthwise direction, are supported in spaced relation at fold locations, or lines, especially at each second fold location, and are cut at certain fold or line locations, preferably at the supported fold locations or lines. Following the cutting or severing operation the sheets of a web are successively brought into a position which is aligned with the next following web, where there is placed upon such sheets the sheets separated from the next following web.

As mentioned above the invention is also concerned with apparatus for the performance of the method aspects wherein there is provided a sheet associating device comprising a support device for each zig-zag folded web formed of sheets interconnected at fold locations or lines extending transversely with respect to the web lengthwise direction. The support device serves for the spaced supporting of the web at fold locations, especially at each second fold location or line. Also there is provided a separator or cutting device for severing the web at certain fold locations, preferably at the supported fold locations or lines. Additionally, conveyor means are provided which, following the severing or cutting of the sheets successively bring one web into a position which is aligned with the next following web.

Since the sheets or the like are interconnected with one another to form a zig-zag folded web up to a point in time directly prior to the actual sheet assembly or gathering operation, the sheets need not be individually handled, rather they can be conjointly manipulated in their composite formation. This facilitates and simplifies the processing, since the sheets within the web always assume a fixed mutual position and by pushing together or extending the web it is possible without difficulty to open the sheets.

According to a preferred construction of the apparatus all of the support devices are constituted by a revolvingly driven drum or drum member, at the circumference of which there are arranged support elements which preferably are structured as webs or ribs extending in the axial direction of the drum. Upon these support ribs there comes to bear the web at fold locations or lines. This enables a continuous superimposing or placing on top of one another the individually separated sheets of the different webs.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Describing now the drawings, it is here mentioned that based upon FIGS. 1 to 4 there initially will be described the zig-zag folding and subsequent stacking of a printed paper web.

Figure 1:
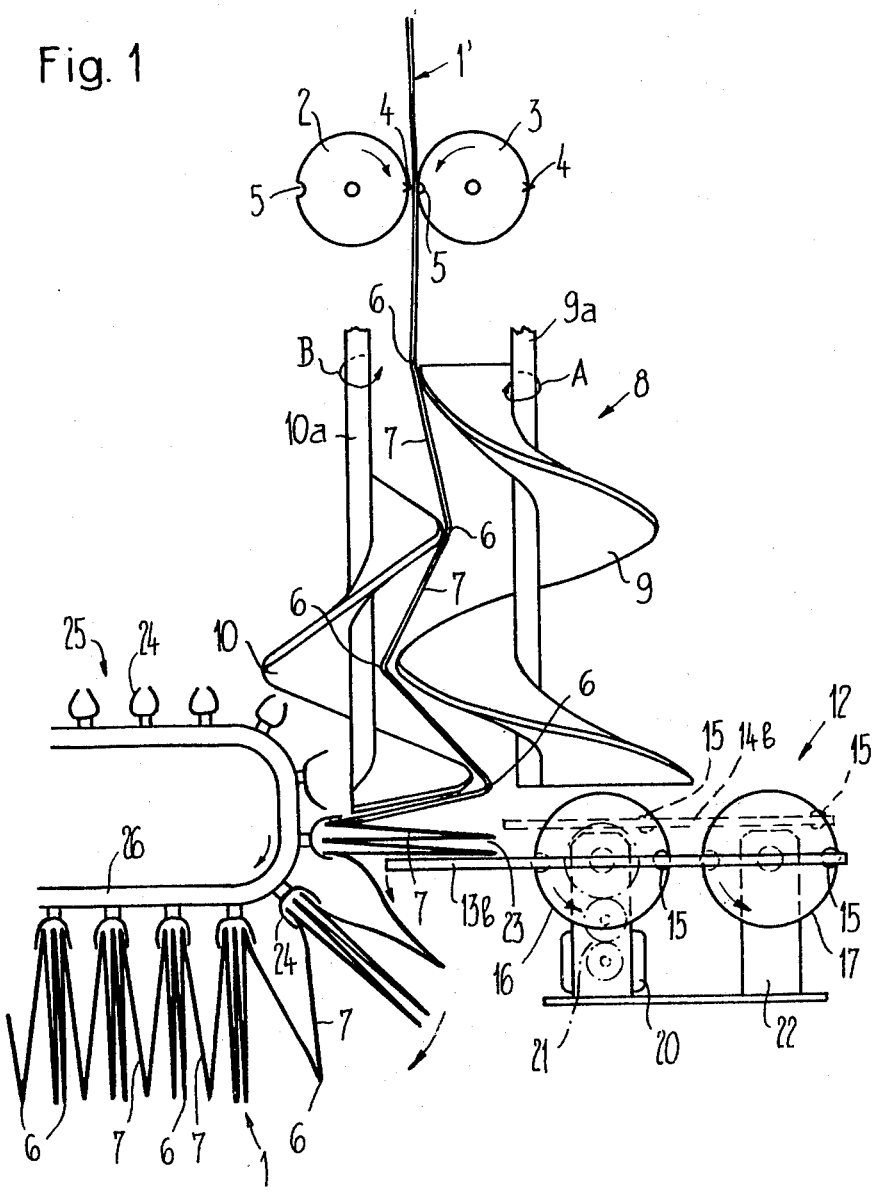
FIG. 1 is a side view of an apparatus for the substantially zig-zag folding of a printed paper web.

Turning attention now specifically to FIG. 1, reference character 1' designates a printed paper web assumed to arrive from a rotary printing machine or press.

This paper web 1' now travels between two schematically illustrated folding or fold rolls 2 and 3 which are driven to rotate in opposite sense, as the same has been schematically represented by the arrows. Each folding roll or roller 2 and 3 possesses a folding knife 4 and a folding groove or channel 5. During the rotation of the folding rolls 2 and 3, as is well known, the folding knife 4 of the one folding roll comes into engagement with the folding groove 5 of the other folding roll, whereby a fold is formed in the paper web 1'. The fold locations or lines which have been formed in this manner have been designated by reference character 6. It is also possible to construct the folding knife 4 as a perforating knife or cutter, so that there is produced a perforation at the fold locations or folds 6. Moreover, it is possible to structure the folding knife 4 in a manner such that the paper web 1' is cut at the fold locations or lines 6 from both marginal sides towards the center over a portion of its width. The individual sheets interconnected with one another at the fold locations 6 have been conveniently designated by reference character 7.

As best seen by referring to FIGS. 1 and 2, a folding device or apparatus 8 is arranged below the folding rolls or rollers 2 and 3 and serves for the zig-zag shaped folding of the paper web 1'. This folding device 8 will be seen to comprise a first folding worm 9 having a large diameter, this worm rotating in the direction of the arrow A about its shaft or axis 9*a*. Arranged opposite this first folding worm 9 are two folding worms 10 and 11 having smaller diameter, which are rotatably driven to rotate about their respective shaft or axis 10*a* and 11*a*, is the same has been indicated in FIG. 1 by the arrow B. The paper web 1' which is pre-folded during its passage between the folding rolls 2 and 3, then during the subsequent passage between the folding worms 9, 10 and 11 is folded in a substantially zig-zag shaped configuration and temporarily deposited upon a deposit device 12.

Figure 2:
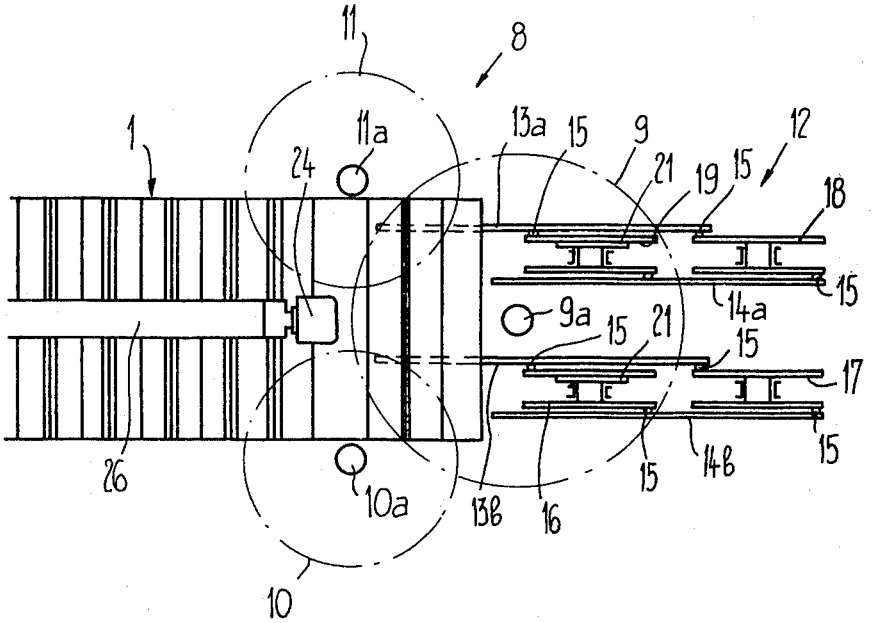
FIG. 2 is a top plan view of the apparatus of FIG. 1.

The deposit or deposition device 12 will be seen to comprise two rod pairs 13*a*, 13*b* and 14*a*, 14*b* as particularly well seen by referring to FIG. 2. The rods of each rod pair 13*a*, 13*b* and 14*a*, 14*b* are moved essentially parallel to one another in a manner to be described more fully hereinafter and serve, during such movement, temporarily as support means for a number of stacked sheets 7. The rods 13*a*, 13*b*, 14*a*, 14*b* are rotatably secured by means of the bearing journals 15 in each case at the one side of drive drums 16, 17, 18 and 19, respectively. Both of the drive drums 16 and 19 are rotatably driven in counterclockwise direction by a drive motor 20 with the aid of gearing 21 or equivalent structure. Both of the other drums 17 and 18 are supported to be freely rotatable in a bearing 22.

During the rotation of the drums 16, 17, 18 and 19 the rod pairs 13*a*, 13*b* and 14*a*, 14*b* are entrainably moved in such a manner that they alternately are introduced, for a certain period of time, into the path of travel of the paper web 1', so that there can form at the rod pairs in each case a partial stack 23, as particularly evident by referring to FIG. 1. Each partial stack 23 consists of a number of superimposed sheets 7.

Each partial stack 23 is engaged at the region of its one side by a gripper or gripper element 24 of a transport device 25 before the rod pair 13*a*, 13*b*, or 14*a*, 14*b*, as the case may be, supporting such partial stack 23 moves away from beneath the partial stack 23. The transport device 25 is of known design and can be constructed, by way of illustration and not limitation, in the manner disclosed in German Patent Publication No. 2,922,450 and the corresponding commonly assigned copending U.S. application Ser. No. 051,344, filed June 25, 1979, now U.S. Pat. No. 4,320,894, granted Mar. 23, 1982. The individual grippers 24 of the transport device 25 are arranged behind one another in the conveying direction and at a mutual spacing from one another and secured to a revolving traction element which is guided within a guide channel 26 shown in FIG. 1. The zig-zag folded paper web, hereinafter conveniently designated by reference character 1, is now transported away by the transport device 25, and, as already mentioned, each gripper or gripper element 24 seizes together a number of sheets.

Figure 3:
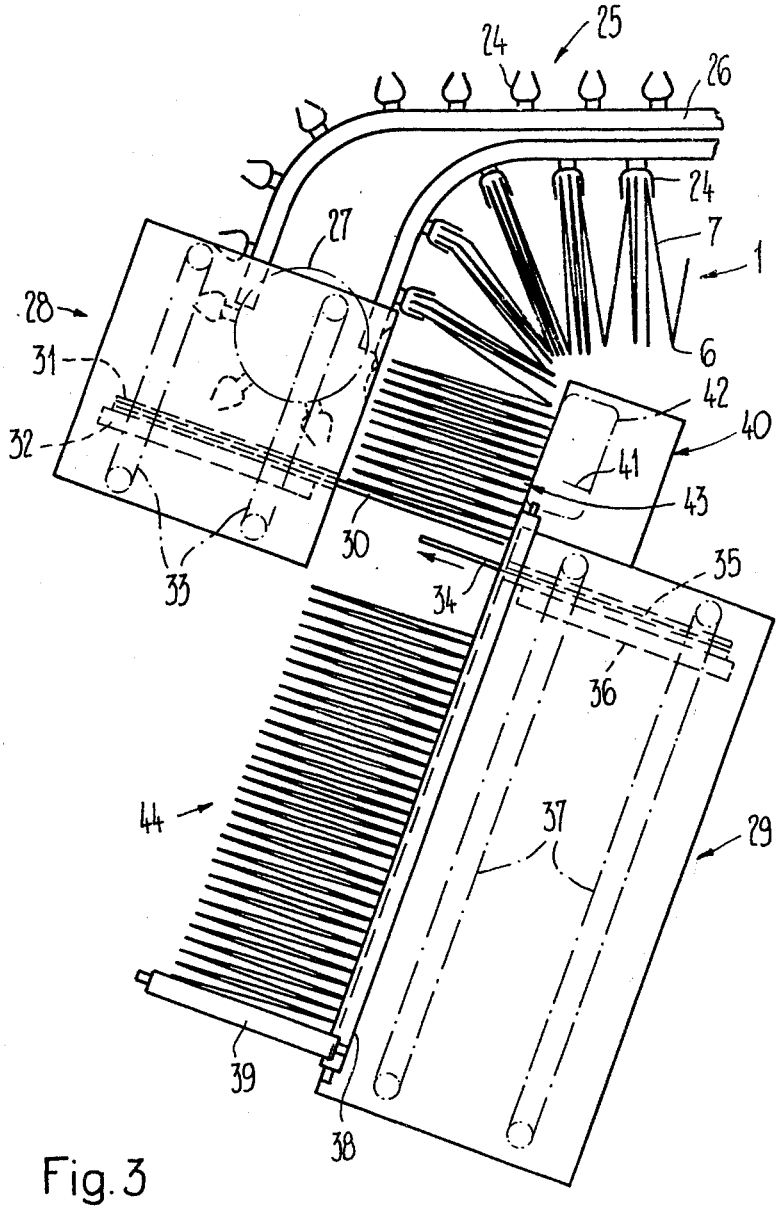
FIGS. 3 and 4 respectively show during different working or operating phases a stacking device or stacker for the paper web folded in the equipment of FIG. 1.
Figure 4:
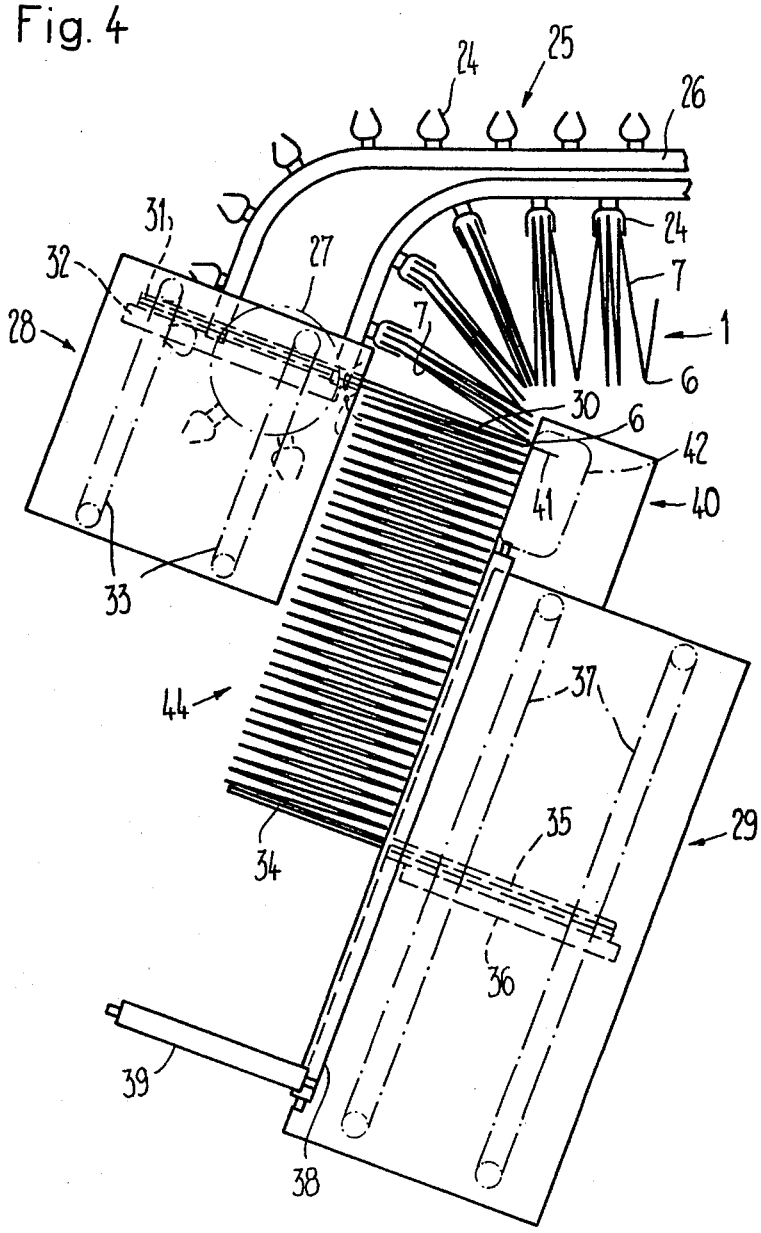
Figure 5:
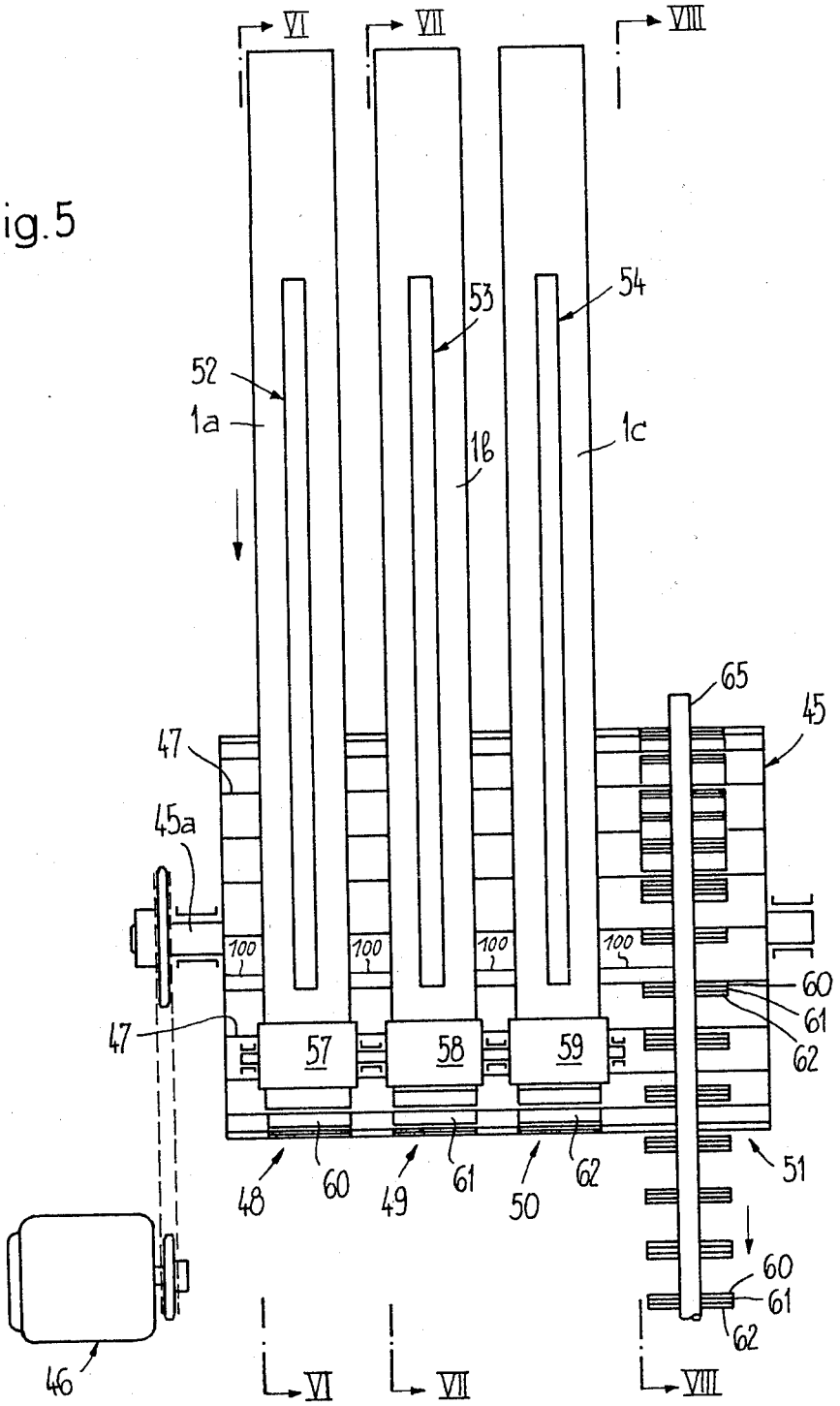
FIG. 5 is a top plan view of an apparatus for the gathering together or assembly of sheets which are interconnected at the fold locations or lines of different zig-zag folded webs.

As best seen by referring to FIGS. 3 and 4, the transport device 25, which is guided at one end over a deflecting wheel or gear 27 or equivalent structure, conveys the paper web 1 to an intermediate stacking device 28 and a stacking device 29. The intermediate stacking device 28 possesses a preferably bifurcated or fork-shaped constructed support element 30 which is guided within a guide or guide means 31 and is moved to-and-fro by a pneumatic drive cylinder 32 within such guide means 31. The support element 30, guide means 31 and pneumatic drive cylinder or cylinder unit 32 are movable up and down by means of an only schematically illustrated but conventional lifting and lowering device 33, also sometimes simply referred to as an elevational displacement device.

The stacking device 29, just as was the case for the intermediate stacking device 28, likewise possesses a preferably bifurcated suport element 34 which is guided in a guide or guide means 35 and can be driven to move to-and-fro by means of a pneumatic drive cylinder 36. The support element 34, guide means 35 and pneumatic drive cylinder 36 can be raised and lowered by means of a likewise only schematically illustrated lifting and lowering device 37. Furthermore, there are also provided rotatably mounted support rolls 38 as well as support rolls 39, the function of which will be described more fully hereinafter. Additionally, there is provided a separation or separator device 40 containing the schematically illustrated separation element or cutter 41, for instance in the form of a rotating separator disc. This separator element 41 is moved along the path of travel generally indicated by reference character 42.

In FIG. 3 the support element 30 is shown in its extended position. The paper web 1 infed by the transport device 25 and released by the grippers 34 now is intermediately stacked into a partial stack 43 upon such support element or support means 30. The previously finished formed stack 44, which bears at its lower end at the support rolls 39 and laterally at the support rolls 38, is now transported away in the meantime in a direction located perpendicular to the plane of the drawing, for instance by driving the support rolls 39 or by means of a suitable pusher device. The support element 34 which is moved back following the transfer of the finished stack 44 onto the support rolls 39, is again moved into the upper end or terminal position by the elevational displacement device or lifting and lowering device 37, where it again can be extended by the action of the pneumatic drive cylinder 36. The support element 30 of the intermediate stacking device 28 is lowered by means of the lifting and lowering device 33 in accordance with the increasing height of the partial stack 43 and transfers at its lower end position the partial stack 43 to the support element 34 of the stacking device 29. Thereafter, the support element 30 is retracted and again moved back into its upper end or terminal position, as best seen by referring to FIG. 4. The support element 34 of the stacking device 29 is now lowered in accordance with the increase in the height of the stack 44 reposing thereon. If the support element 34 has reached its lower end position, then there is accomplished the already described transfer of the finished stack 44 to the support rolls 39.

If the stack 44 formed upon the support element 34 has reached the desired height, then the support element 30 of the intermediate stacking device 28 is again ejected or extended, as such has been illustrated in FIG. 4. Now there is formed a further partial stack upon this support element 30, as the same has already been described. The separator or cutter element 41 is now located opposite the support element 30 and severs the uppermost sheet of the finished stack 44 from the next following sheet 7, and specifically, at the connection location or fold 6 between both of these sheets.

In the described manner there is then formed from the paper web 1, continuously infed by the transport device 25, individual stacks 44 which are now intermediately stored or can be infed to a further processing device.

Based upon the showing of FIGS. 5 to 8 there now will be described the gathering together or assembly of sheets which are interconnected with one another to form different zig-zag folded webs. The folding and stacking of the different webs is accomplished in the manner described previously based upon the showing of FIGS. 1 to 4.

As will be seen from FIGS. 5 to 8 there is provided a drum member or drum 45 of a sheet associating device which, in a manner still to be described, serves as support device for the webs which are to be processed. The shaft 45*a* of the drum member 45 is connected with a suitable drive means or drive, generally indicated by reference character 46, this drive 46 rotating the drum member 45 in the direction of the arrow C. At the circumference of the drum member 45 there are arranged support elements 47 in the form of radially protruding webs or ribs which extend in the axial direction of the drum member 45 essentially over its entire width. The drum member 45 possesses three infeed or inlet sections or portions 48, 49 and 50 located adjacent one another in the axial direction of such drum member and also possesses a removal or outfeed section or portion 51 which is offset in axial direction in relation to the infeed sections 48, 49 and 50. Each infeed or inlet section 48, 49 and 50 has infed thereto a substantially zig-zag folded paper web 1*a*, 1*b* and 1*c*. For this purpose there is arranged forwardly of each infeed section 48, 49 and 50 a respective transport device 52, 53 and 54 equipped with individual grippers or gripper elements 55 arranged behind one another in the feed or conveying direction. Each transport device 52, 53 and 54 corresponds in its construction to the structure of the transport device 25 shown in FIGS. 1 to 4.

Figure 6:
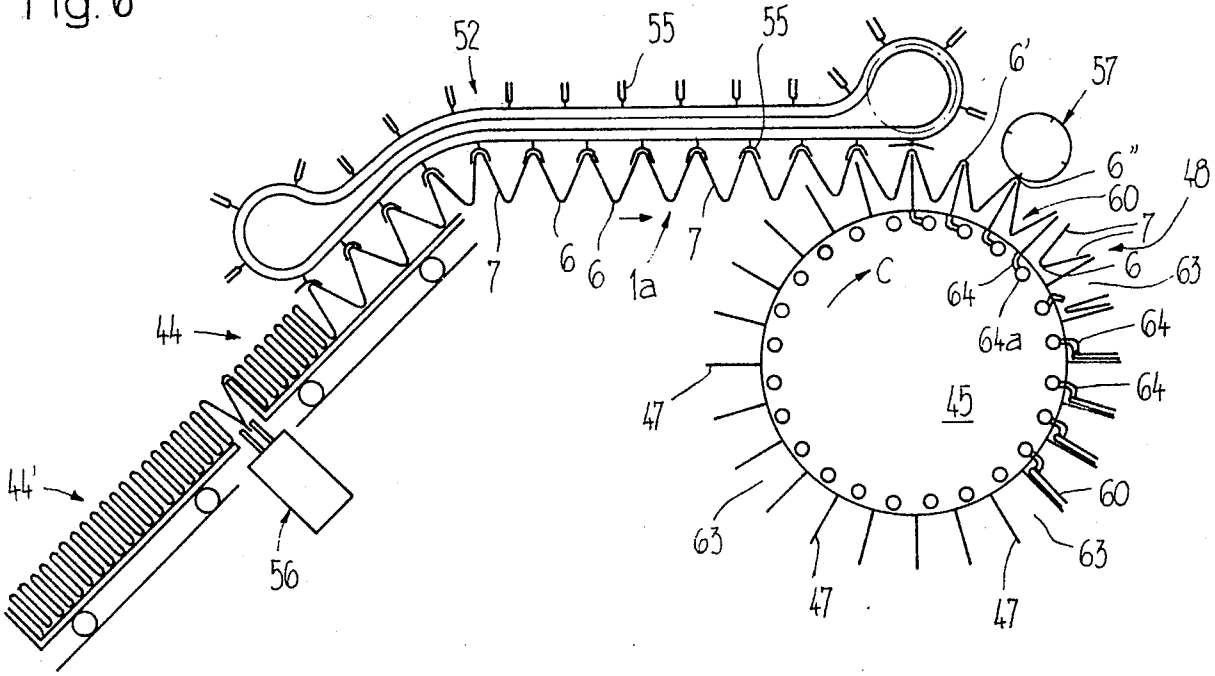
FIG. 6 is a cross-sectional view of the arrangement of FIG. 5, taken substantially along the line VI—VI thereof.

As best seen by referring to FIG. 6, each transport device 52, 53 and 54 interconnects the therewith operatively associated infeed section 48, 49 and 50, respectively, with a supply source for the paper webs 1*a*, 1*b*, 1*c*, respectively. In the embodiment under discussion the supply source is constituted in each case by a stack 44, which is formed in the manner described previously based upon the showing of FIGS. 3 and 4. As best seen by referring to FIG. 6, to enable a continuous infeed of the web there is provided a connecting or linking apparatus 56 which, in known manner, always interconnects two stacks 44 and 44' with one another.

However, it is also possible to infeed the webs 1*a*, 1*b* and 1*c*, instead of from stacks 44, from an intermediate storage which is directly supplied by the printing press and in which there does not occur a separation of the continuously arriving web into individual stacks.

Figure 7:
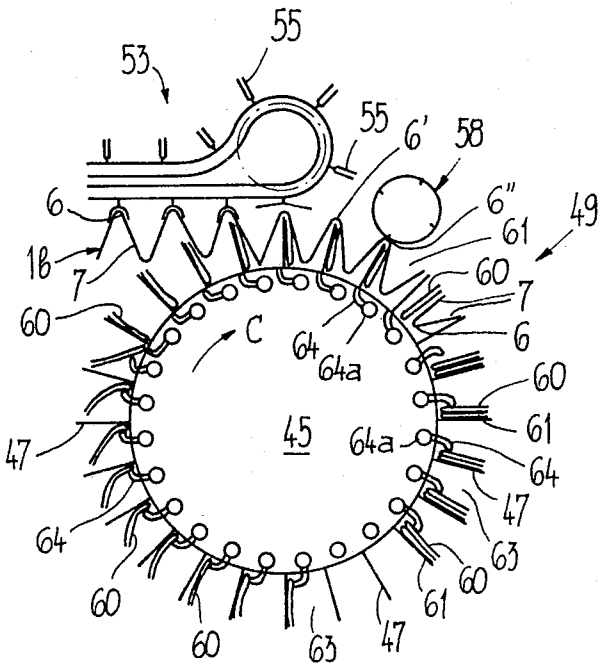
FIG. 7 is a cross-sectional view of the arrangement of FIG. 5, taken substantially along the line VII—VII thereof.
Figure 8:
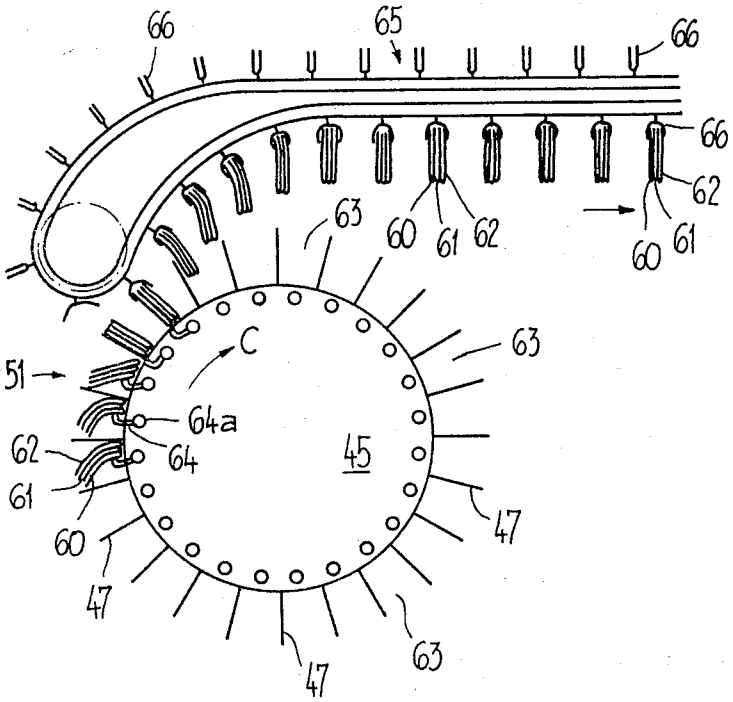
FIG. 8 is a cross-sectional view of the arrangement of FIG. 5, taken substantially along the line VIII—VIII thereof.

As will be seen by referring to FIGS. 6 and 7, the grippers or gripper elements 55 seize the webs 1*a*, 1*b*, and 1*c*, respectively, at each second fold location 6 and transport the webs 1*a*, 1*b* and 1*c* in accordion-like fashion to the corresponding inlet section or portion 48, 49 and 50, respectively. In each inlet section 48, 49 and 50 there is placed the related web 1*a*, 1*b* and 1*c* upon the support elements 47 such that each second fold location 6' comes to bear upon a support element 47. Between each two neighboring support elements 47 there thus bear two sheets 7 interconnected with one another at a fold location 6.

Situated opposite each web 1*a*, 1*b* and 1*c* of the related infeed section 48, 49 and 50, respectively, is a schematicaly illustrated separator or cutting device 57, 58 and 59, respectively, which severs or cuts the related web 1*a*, 1*b* and 1*c* at each fold location on line 6' bearing upon a support element 47. Consequently, there are formed individual sheets 60, 61 and 62, respectively, which consist of two sheets 7 interconnected with one another at a fold location or line 6. Each sheet 60, 61 and 62 comes to lie in a compartment 63 which is formed in each case by two neighboring support elements 47.

Operatively associated with each compartment 63 is a schematically illustrated pressure finger 64 which is pivotable about a shaft or axis designated by reference character 64*a*. The control of the pressure finger 64 may be accomplished in accordance with the teachings of German Patent Publication No. 2,604,101 and the corresponding U.S. Pat. No. 4,058,202, incorporated herein by reference.

As best seen by referring to FIG. 6, during rotation of the drum member 45 the individual sheets 60 come to bear at a support element 47 forming the wall of a compartment 63. Additionally, the pressure or contact finger 64 is pivoted into its effective or operative position where it presses the sheet against the support element 47, so that the sheets 60 are retained against dropping out of the compartments 63. During the further rotation of the drum member 45 the sheets 60 are displaced in the axial direction of the drum member 45 towards the neighboring infeed section or portion 49, so that at this infeed section 49 they are aligned with the arriving web 1*b*, as indicated in FIG. 7. After reaching the lowermost point of the drum member 45 the pressure finger 64 is gradually again rocked back into the rest position, so that the printing sheets come to bear at the other support element 47 at the same compartment 63, as best recognized by referring to FIG. 7.

The second web 1*b* which is infed to the infeed section or portion 49 is severed or cut by means of the cutter device 58 at the fold locations lines 6' bearing upon the support elements 47, as the same has already been described based upon the first paper web 1*a*. As will be apparent from the illustration of FIG. 7, in each compartment or portion 63 there comes to bear upon a sheet 61 a sheet 60 which has been severed from the first web 1*a*, this sheet 61 having been cut or separated from the second web 1*b*. As already described in conjunction with FIG. 6, both of the superimposed sheets 60 and 61 are retained by the pressure finger 64 and forwardly advanced conjointly in axial direction towards the third infeed section or portion 50 during the further rotation of the drum member 45. At this third infeed section 50 both of the sheets 60 and 61 which are reposing upon one another are placed upon a third sheet 63 which, in the previously described manner, has been obtained by cutting the third web 1*c*. The three superimposed sheets 60, 61 and 62, during further rotation of the drum member 45, are forwardly displaced in axial direction towards the removal portion or section 51, where they can be removed by a transport device 65 from the drum member 45, as best recognized by referring to FIG. 8. The transport device 65, which corresponds in its construction to the construction of transport device 25 illustrated and described previously in conjunction with FIGS. 1 to 4, likewise possesses grippers or gripper elements 66 arranged behind one another in the feed or conveying direction, of which each removes the superimposed sheets 60, 61 and 62 out of a compartment 63 and infeeds such to a not here further illustrated further processing station.

The transport of the sheets 60, 61 and 62 in axial direction of the drum member 45 is accomplished basically in the manner described in German Patent Publication No. 2,447,336 and the corresponding U.S. Pat. No. 3,951,399 and German Patent Publication No. 2,604,101 and the corresponding U.S. Pat. No. 4,058,202, to which reference may be readily had and the disclosure of which is incorporated herein by reference. Therefore in FIG. 5 such axial transport means has merely been schematically indicated for one of the compartments 63 by reference character 100.

Based upon the previously described principles it is readily possible to perfect other modifications or variants of the described exemplary embodiment. Thus, the individual webs 1*a*, 1*b* and 1*c* need not be single ply, as shown, rather also can be multi-ply. In the last-mentioned case the webs are formed by a number of superimposed partial webs which also can be interconnected with one another at their fold locations.

Instead of using a single support device which is common to all of the webs it is possible to provide for each web a support device whis is separate from the support devices for the other webs.

Instead of arranging, as shown, the support elements 47 at the circumference of a drum 45, i.e. along a curved surface, it is also possible to arrange the support elements along a flat or planar surface, for instance in the manner of rungs of a ladder.

As is known from the conventional assembly or gathering devices there also can be provided a collecting band for placing on top of one another the different sheets or panels or the like of the different webs, and which interconnects the support devices with one another. The individual sheets or panels or the like which have been cut from the web bearing upon the support device are deposited by means of a suitable device upon the collecting band or belt.

It would be also conceivable to place during the rotation of the drum, at suitable locations, inserts upon the sheets or panels lying in the compartments, these inserts being introduced from the outside or circumference of the drum member.

It is to be understood that in the context of this disclosure the term "sheets" is used in its broader sense to cover most different types of sheets, panels, or sheet-like flat structures which can be handled with the equipment of the invention.

While there are shown and described present preferred embodiments of the invention, it is to be distinctly understood that the invention is not limited thereto, but may be otherwise variously embodied and practiced within the scope of the following claims.

Accordingly, what I claim is:

1. An apparatus for gathering together sheets to form multi-sheet printed products, especially newspapers, magazines and periodicals, wherein the sheets are supplied from webs which are each constituted by printed sheets which are interconnected with one another at fold lines extending transversely with respect to the lengthwise direction of the webs, comprising:

a sheet associating device having support means for independently supporting each of at least two zig-zag folded webs defining a first web and at least one other web, each constituted by printed sheets which are interconnected with one another at fold lines extending transversely with respect to the lengthwise direction of the webs, at predetermined fold lines;

cutting means for cutting each web independently of one another at given ones of said fold lines to form cut sheets therefrom;

said cutting means cutting said first web after it has been introduced to said sheet associating device at given ones of said fold lines to allow the sheets to be supported at said sheet associating device between said support means and thereafter cutting said at least one other web after it has been introduced to said sheet associating device at given ones of said fold lines to allow the sheets thereof to be supported at said sheet associating device between said support means; and means for bringing the cut sheets of said first web successively into a position aligned with the cut sheets of said at least one other web following the severing of said first web and depositing upon such sheets severed from said first web the sheets severed from said at least one other web.

2. The apparatus as defined in claim 1, wherein:

said one other web defines a second web;

support means for supporting at least a zig-zag folded third web independently of said first and second webs at predetermined fold lines;

cutting means for cutting said third web at given ones of fold lines; and means for bringing the superimposed sheets of said first and second webs successsively into a position aligned with said third web and depositing upon such sheets severed from said first and second webs the sheets severed from said third web.

3. The apparatus as defined in claim 1, wherein:

said cutting means serve to sever the webs at alternate fold lines thereof.

4. The apparatus as defined in claim 1, further including:

an infeed device having a predetermined conveying direction provided for each web and arranged upstream of the operatively related support means; and said infeed device comprising controllable grippers which seize the web and which are arranged behind one another in the conveying direction of the infeed device.

5. The apparatus as defined in claim 1, wherein:

said support means serves to support the web at each second fold line.

6. The apparatus as defined in claim 1, wherein:

said cutting means serves to sever the web at the supported fold lines.

7. The apparatus as defined in claim 1, wherein:

said bringing means comprises a band conveyor interconnecting the support means.

8. The apparatus as defined in claim 1, wherein:

each support means contains support elements arranged in spaced relationship from one another; and each of the webs resting upon said support elements at fold lines of the web.

9. The apparatus as defined in claim 8, wherein:

all of the support means are formed by a revolvingly driven drum member; and said support elements being arranged at the circumference of the drum member.

10. The apparatus as defined in claim 9, wherein:

said support elements are structured as rib means extending in the axial direction of said drum member and upon which rest the webs at fold lines thereof.

11. The apparatus as defined in claim 9, wherein:

said drum member comprises at least two infeed portions for the individual webs and a removal portion for the superimposed sheets; and said infeed portions and said removal portion being offset with respect to one another in the axial direction of the drum member.

12. The apparatus as defined in claim 11, further including:

an outfeed device having a predetermined conveying direction arranged following the drum member at the removal portion; and said outfeed device containing controllable grippers arranged behind one another in the conveying direction of the outfeed device and which engage the superimposed sheets.

13. The apparatus as defined in claim 11, further including:

a respective one of said cutting means provided at each infeed portion and located opposite the drum member with respect to the related web.

14. The apparatus as defined in claim 11, wherein:

said bringing means comprise feed means driven in synchronism with the rotation of the drum member and effective in the axial direction of the drum member.

15. The apparatus as defined in claim 11, wherein:

said support elements neighboring one another in pairs;

each neighboring pair of support elements forms a respective compartment;

a connectable and disconnectable holder device arranged in each compartment and serving to fixedly retain the sheets during part of the revolution of the drum member.

16. An apparatus for gathering together sheets into multi-sheet printed products, comprising:

a support device for the spaced supporting of each one of zig-zag folded webs at their fold locations;

each of said webs comprising a substantially zig-zag folded web formed of sheets interconnected with one another at fold locations extending transversely with respect to the lengthwise direction of the web;

a cutting device for cutting each web at predetermined fold locations;

transport means which following the cutting of the sheets serves to bring the sheets of a first one of said webs into a position aligned with a next following web;

each support device containing support elements arranged in spaced relationship from one another;

each web resting upon said support elements at fold locations of the web;

all of the support devices being formed by a revolvingly driven drum member;

said support elements being structured as rib means upon which rest said webs and arranged at the circumference of the drum member and extending in the axial direction of said drum member;

said drum member comprising at least two infeed portions for the individual webs and a removal portion for superimposed sheets formed from said webs; and said infeed portions and said removal portion being offset with respect to one another in the axial direction of the drum member.

17. The apparatus as defined in claim 16, further including:

an outfeed device having a predetermined conveying direction arranged following the drum member at the removal portion; and said outfeed device containing controllable grippers arranged behind one another in the conveying direction of the outfeed device and which engage the superimposed sheets.

18. The apparatus as defined in claim 16, further including:

a respective one of said cutting devices provided at each infeed portion and located opposite the drum member with respect to the related web.

19. The apparatus as defined in claim 16, wherein:

said transport means comprise feed means driven in synchronism with the rotation of the drum member and effective in the axial direction of the drum member.

20. The apparatus as defined in claim 16, wherein:

said support elements neighboring one another in pairs;

each pair of neighboring support elements forming a respective compartment; and a connectable and disconnectable holder device arranged in each compartment and serving to fixedly retain the sheets during part of the revolution of the drum member.

21. A method of gathering together sheets to form multi-sheet printed products, especially newspapers, magazines and periodicals, wherein the sheets are supplied from webs which are each constituted by printed sheets which are interconnected with one another at fold lines extending transversely with respect to the lengthwise direction of the webs, comprising the steps of:

step (a) feeding a first web to a sheet associating device having means for supporting said first web at predetermined ones of the fold lines;

step (b) severing said first web after it has been introduced to said sheet associating device at given ones of said fold lines to allow the sheets to be supported at said sheet associating device between said supporting means;

step (c) following the severing of said first web repeating steps (a) and (b) with a second and subsequently supplied webs and bringing the sheets of said first web successively into a position aligned with sheets of other of said supplied webs; and step (c) depositing upon the sheets severed from said first web the sheets severed from said other webs.

22. The method as defined in claim 21, wherein:

step (c) of subsequently supplied web includes;

supporting at least a third zig-zag folded web independently of the first and second webs at predetermined fold lines;

severing said third web independently of the first and second webs at given ones of said fold lines;

bringing the superimposed sheets of said first and second webs successively into a position aligned with said third web; and depositing upon such sheets severed from said first and second webs the sheets severed from said third web.

23. The method as defined in claim 21, further including the steps of:

severing said first and second webs at each second fold line thereof.

24. The method as defined in claim 21, wherein:

said webs are supported at each second fold line thereof.

25. The method as defined in claim 21, wherein:

the severing of the webs is accomplished at each of the supported fold line thereof.

* * * * *